United States Patent [19]

Divisek et al.

[11] Patent Number: 4,559,124

[45] Date of Patent: Dec. 17, 1985

[54] NICKEL OXIDE BASED DIAPHRAGM

[75] Inventors: Jiri Divisek; Peter Malinowski, both of Jülich, Fed. Rep. of Germany

[73] Assignee: Kernforschungsanlage Jülich Gesellschaft mit beschränkter Haftung, Jülich, Fed. Rep. of Germany

[21] Appl. No.: 613,877

[22] Filed: May 24, 1984

[30] Foreign Application Priority Data

May 24, 1983 [DE] Fed. Rep. of Germany ..... 3318758

[51] Int. Cl.[4] ..... C25B 13/00

[52] U.S. Cl. ..... 204/295; 204/129

[58] Field of Search ..... 204/295

[56] References Cited

U.S. PATENT DOCUMENTS

| | | | |
|---|---|---|---|
| 3,957,534 | 5/1976 | Linkohr | 429/247 |
| 4,119,503 | 10/1978 | Spaziante | 204/295 |
| 4,356,231 | 10/1982 | Divisek | 427/180 |
| 4,394,224 | 7/1983 | Mahoon | 204/57 |
| 4,394,244 | 7/1983 | Divisek | 204/295 |
| 4,445,994 | 5/1984 | Divisek | 204/295 |
| 4,447,302 | 5/1984 | Brennecke | 204/290 R |

OTHER PUBLICATIONS

Proceedings of the 2nd World Hydrogen Energy Conference, held in Zurich, Switzerland, Aug. 21-24, 1978—Hydrogen Energy System, vol. 1 *The Use of Porous Metallic Diaphragm for Hydrogen Mass-Production with Alkaline Water Electrolysis*—P. Perroud and G. Terrier, pp. 241-247.

Noyes Data Corporation, Park Ridge, N.J., U.S.A. 1978 *Hydrogen Manufacture by Electrolysis, Thermal Decomposition and Unusual Techniques,* pp. 190-191 (1978).

Int. J. Hydrogen Energy, vol. 8, No. 2, pp. 81-83, 1983 *Developments on Ime-Alkaline Water Electrolysis*—Vandenborre, Leysen, Nackaerts.

Commission of the European Communities—*Seminar on Hydrogen as an Energy* Vector: Its Production, Use and Transportation—Brussels, Oct. 3 and 4, 1978, pp. 277 and 286.

Proceedings of the 4th World Hydrogen Energy Conference, California U.S.A. Jun. 13-17, 1982, vol. 1—*Hydrogen Energy Progress*-IV, pp. 129-131.

*Primary Examiner*—John F. Niebling

*Attorney, Agent, or Firm*—Nils H. Ljungman

[57] ABSTRACT

The invention concerns a NiO-based ceramic oxide diaphragm for the alkaline water electrolysis. The diaphragm, in accordance with the invention, contains 0.5 to 10% by weight (estimated as Ti based on the oxide mass) of titanium oxide in the porous NiO layer. Diaphragms of this type are obtained, in particular, by the oxidative sintering of a mass of nickel powder which has been applied under pressure to a nickel support, especially one consisting of nickel wire gauze. In the process the titanium is in the form of titanium metal, titanium oxide or a titanium compound which is added to the initial nickel powder. The titanium is present in the form of its oxide after the oxidation sintering treatment. In an alternative embodiment of the process, an already sintered porous mass of nickel or nickel oxide can be impregnated with a titanium compound and calcined to convert the titanium compound to its oxide.

4 Claims, 3 Drawing Figures

NICKEL OXIDE BASED DIAPHRAGM

BACKGROUND OF THE INVENTION

1. Field of the Invention

The invention relates to diaphragms used in the alkaline water electrolysis. More particularly, this invention relates to an improved nickel oxide based diaphragm and a method for producing the same.

2. Discussion of the Prior Art

In general, the alkaline water electrolysis was effected at relatively low temperatures (below 90° C.). It has been necessary to employ such temperatures due to the low chemical stability of the asbestos diaphragms normally used in hot KOH. These low temperatures are both thermodynamically and kinetically disadvantageous. As a result, unnecessarily high electrolysis voltages are required and the whole process is uneconomical on energetic grounds.

For this reason, there has been a long felt need either to improve the stability of asbestos in hot KOH or to find other diaphragm materials.

Thus, potassium silicate has been added to the KOH electrolyte in order to reduce the solubility of asbestos in KOH (R. L. Vic et al. in "Hydrogen Energy Progress" IV, 4th WHE Conference, June 13–17, 1982, California, pages 129–140). It is evident that this measure cannot be looked upon as being entirely satisfactory.

The same authors also employed a diaphragm of teflon-bound potassium hexatitanate which was originally developed by the Energy Research Corporation (see also M. S. Casper, "Hydrogen Manufacture by Electrolysis, Thermal Decomposition and Unusual Techniques", Noyes Data Corp., Park Ridge, 1978, p. 190). This diaphragm is, however, somewhat expensive and the voltage drop stemming from the diaphragm is comparable with that of the asbestos diaphragm (see M. S. Casper supra).

Described in the International Journal of Hydrogen Energy, 8, (1983), pages 81–83, is another separator for use in alkaline water electrolysis, which separator uses polyantimonic acid bonded with polysulfone and acts as an ion exchanger. This separator is still in the development stage and is not, therefore, available. A serious drawback associated with this separator is, in any event, its high electrical membrane resistance of 1.0 to 0.8 ohms·cm$^2$ at room temperature.

Consequently, other diaphragms with a lower electrical resistance were produced as, for example, a diaphragm comprising a sintered oxide ceramic (J. Fischer, H. Hofmann, G. Luft and H. Wendt: Seminar "Hydrogen as Energy Vector" Commission Europ. Comm., Oct. 3–4, 1978, Brussels, pages 277–290). While this diaphragm is distinguished by its very good electrical resistance (0.027 to 0.27 ohms·cm$^2$ at 25° C.), its production is not simple and requires: (i) the production of a suitable oxide material such as $ZrO_2$, $BaTiO_3$, $K_2Ti_6O_{13}$, etc., which is effective as the main component of the porous layer, and (ii) the sintering together of the powder at high temperatures in the range between 1300° C. and 1700° C.

Further, proposals have been made to produce porous metal diaphragms from sintered nickel (P. Perroud and G. Terrier: "Hydrogen Energy System", Proc. 2nd WHE Conference, Zürich 1978, page 241). These have a very low electrical resistance and are also mechanically stable and inexpensive. The great drawback encountered in these diaphragms resides in the fact that, like the electrodes, they are also electron-conducting and as a result, with a compact form of construction geometry, there is too great a danger of a short-circuit.

In order to overcome the aforedescribed problems encountered due to electron conductivity, the inventors have developed porous nickel oxide diaphragms which are obtained by the oxidation of sintered metal at an elevated temperature as taught in U.S. Pat. No. 4,394,244 or, more simply, by the oxidative calcination of a nickel powder layer pressed on to a support as taught in U.S. Pat. No. 4,356,231. These Ni oxide diaphragms pose outstanding properties as separators for the alkaline water electrolysis process. The contents of the aforementioned U.S. Pat. Nos. 4,394,244, and 4,356,231 are incorporated herein by reference as if set forth herein in full.

The diaphragms obtained by these simplified production methods have since been used repeatedly in the most varied electrolysis investigations and have proven to be successful. Thus a check was made of their long-term stability in the alkaline water electrolysis process, the longest testing period until now being over 8000 hours at 120° C. The diaphragms were still intact after this period of use. To be sure, thermodynamic considerations suggest that, after a sufficiently long time, these diaphragms could be reduced to nickel, on the cathode side, either by the cathode itself or by the hydrogen which is produced. Opposing this thermodynamically conditioned effect is only a kinetically conditioned restraint which must diminish after a hitherto unknown time. While this can be fully adequate for the purpose of a water electrolysis, there remains, however, some level of uncertainty.

The following test shows that these considerations are correct:

A diaphragm prepared in accordance with U.S. Pat. No. 4,356,231 was exposed to a hydrogen atmosphere at 200° C. In the process, a gradual reduction of the NiO to Ni was observed which suddenly increased after 1500 hours, so that after 2000 hours the entire NiO content was completely reduced.

This reduction actually proceeds much more slowly in the temperature range 140° to 170° C., but it is still appreciable, however, as may be seen from FIG. 1. After 2000 hours, 7% of the oxygen contained in the NiO has been removed. (Stabilization sets in after about 4500 hours, in which case about 10% of the oxygen will have been removed).

Ceramic diaphragms made from thermodynamically-stable oxides such as, for example, $ZrO_2$, $BaTi_3$, $K_2Ti_6O_{13}$, etc., (see above) do not undergo such a reductive attack by hydrogen. However, the production of such diaphragms is associated with the drawbacks already described above, especially with very high production temperatures, and are attacked in the course of time in 10 N KOH at elevated temperatures.

On the other hand, the NiO diaphragm, produced "in situ" in accordance with the U.S. Pat. No. 4,356,231, is lye-resistant and its production not only involves the use of an inexpensive starting material, but also offers the decisive technological advantage in that the exothermic reaction $$2Ni+O_2 \rightarrow 2NiO$$

first begins during the production of the diaphragm. As a result, there is a considerable local increase in temperature and the external production temperature can remain at 1000° C., which is advantageous. Furthermore, as a result of the production process, including oxidation-sintering, there is no need to maintain an inert atmosphere. This also signifies a considerable simplification.

OBJECTS OF THE INVENTION

It is therefore an object of this invention to improve the reduction stability of a nickel oxide diaphragm under the conditions which exist during the alkaline water electrolysis.

It is also an object of this invention to provide a process for the manufacture of a nickel-oxide based diaphragm.

SUMMARY OF THE INVENTION

One aspect of the invention resides in a process for producing a diaphragm for use in the alkaline water electrolysis comprising the steps of: pressure compacting a layer of nickel powder on a substrate; sintering said substrate at a temperature sufficient to oxidize said nickel powder and to attain an electrical insulating effect adequate to enable the diaphragm to be utilized in electrolysis; impregnating the oxidized nickel powder with a titanium compound; and calcining said titanium impregnated oxidized nickel powder to convert the titanium to an oxide form.

Another aspect of the invention resides broadly in a process for producing a diaphragm for use in the alkaline water electrolysis comprising the steps of: adding, to a mass of nickel powder, titanium oxide up to 20% by weight, based on the sum of metallic nickel and titanium oxide; pressure compacting said admixture on a substrate; and sintering said substrate at a temperature sufficient to oxidize said admixture and to attain an electrical insulating effect adequate to enable the diaphragm to be utilized in electrolysis.

The nickel oxide-based diaphragm developed in accordance with the invention is characterized by a titanium content of 0.5 to 10% by weight based on the mass of oxide; the titanium being in the mass in oxidied form.

It was found, surprisingly, that the reduction stability of the NiO diaphragm was increased to an extraordinary degree when, in the production of the diaphragm, $TiO_2$ was added to the nickel powder in amounts of 1 to 20% by weight (based on the sum of metallic nickel and titanium dioxide). Particularly advantageous was a titanium oxide admixture of 2 to 10% by weight and especially of 5% by weight (as titanium oxide, based on the sum of metallic nickel and $TiO_2$).

The particle size of the admixed powder should be comparable with that of the nickel powder, or smaller, in order to ensure a uniform distribution of the titanium over the oxide mass.

In producing the diaphragm, instead of titanium oxide, it is possible to admix with the mass of nickel powder titanium in metallic form or in the form of a titanium compound, either of which is converted into titanium oxide during the oxidation sintering treatment. If need be, an already produced nickel oxide diaphragm can be impregnated with a titanium compound which is converted into the oxidized form by subsequent heating.

BRIEF DESCRIPTION OF THE DRAWINGS

The above, as well as other features and advantages of the present invention, will be more readily appreciated through consideration of the detailed description of the invention in conjunction with the accompanying drawings in which.

DETAILED DESCRIPTION OF THE INVENTION

Example 1

Figure 3:
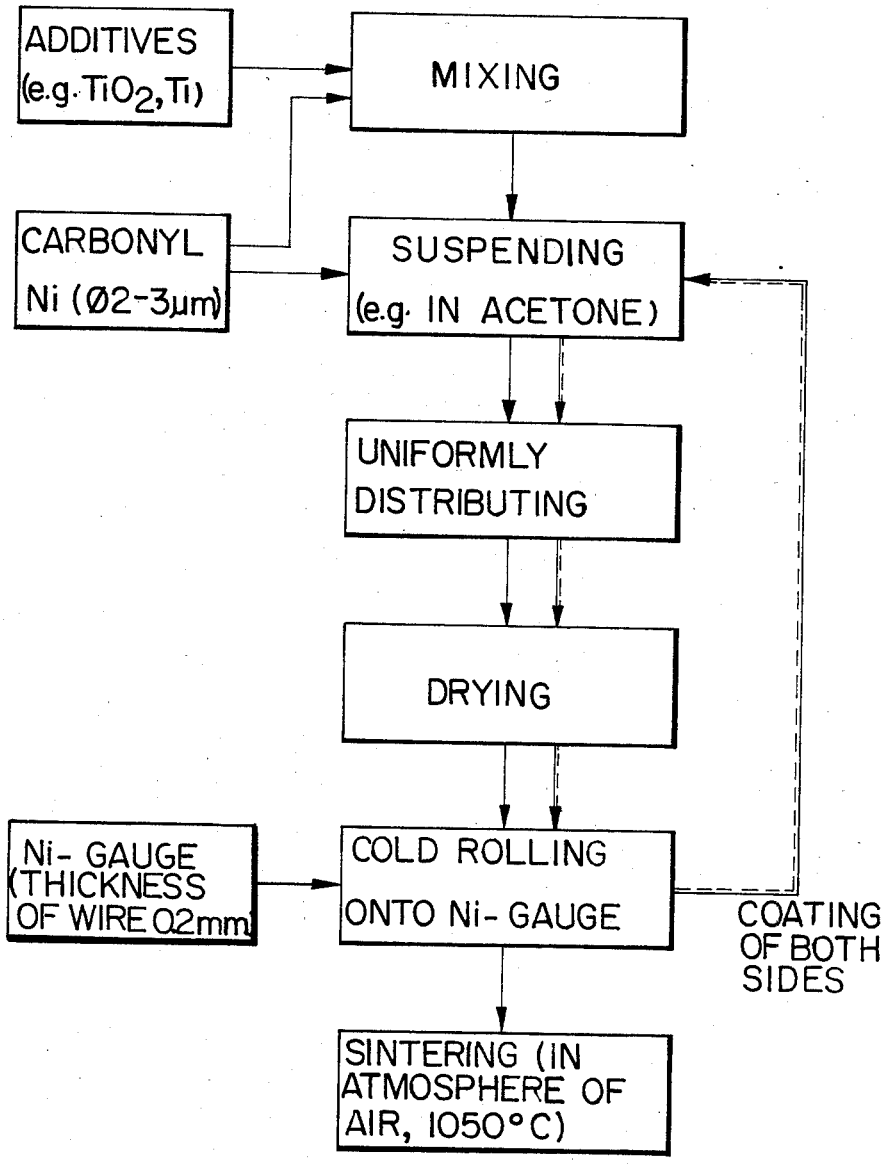
FIG. 3 presents a flow diaphragm showing the various stages in the production of nickel oxide diaphragms made in accordance with the invention.

A NiO-based ceramic diaphragm was prepared in accordance with U.S. Pat. No. 4,356,231 with the addition of $TiO_2$. This preparation incorporated the individual production stages shown in FIG. 3.

Commercially available carbonyl nickel powder (INCO-255; particles size 2 to 3 μm) was mixed with 10% by weight (based on the powder mixture, that is, Ni+-$TiO_2$) of commercially available $TiO_2$, manufactured by the Merck Company, the mixture then being suspended in acetone and uniformly distributed on a smooth surface. After evaporating-off the suspension medium, the layer thus obtained was cold-rolled on to nickel gauze (wire thickness 0.2 mm, mesh width 0.25 mm). The procedure was repeated to cover the second side of the nickel gauze with a powder layer. The uniformly distributed powder layer can also be obtained without any suspension medium according to known practice. Finally the assembly was sintered in air for 20 minutes at 1050° C.

The advantageous physical properties of the diaphragm thus obtained, such as electrical resistance, mechanical stability, porosity or thickness were in no way worsened by comparision with diaphragms made in accordance with U.S. Pat. No. 4,356,231.

Figure 1:
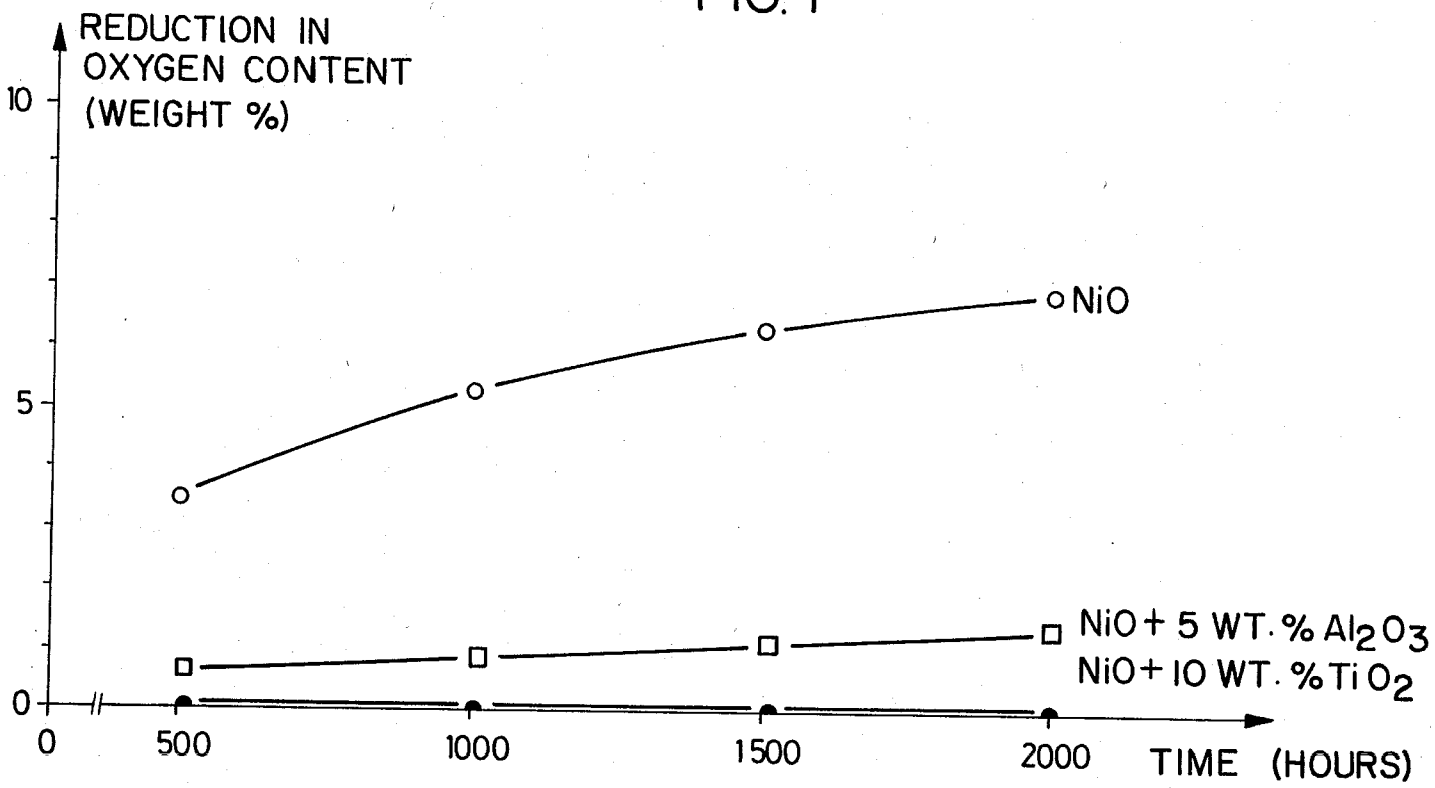
FIG. 1 presents curves which illustrate the susceptibility of nickel oxide diaphragms to be reduced in a hydrogen atmosphere at temperatures of 140° to 170° C.
Figure 2:
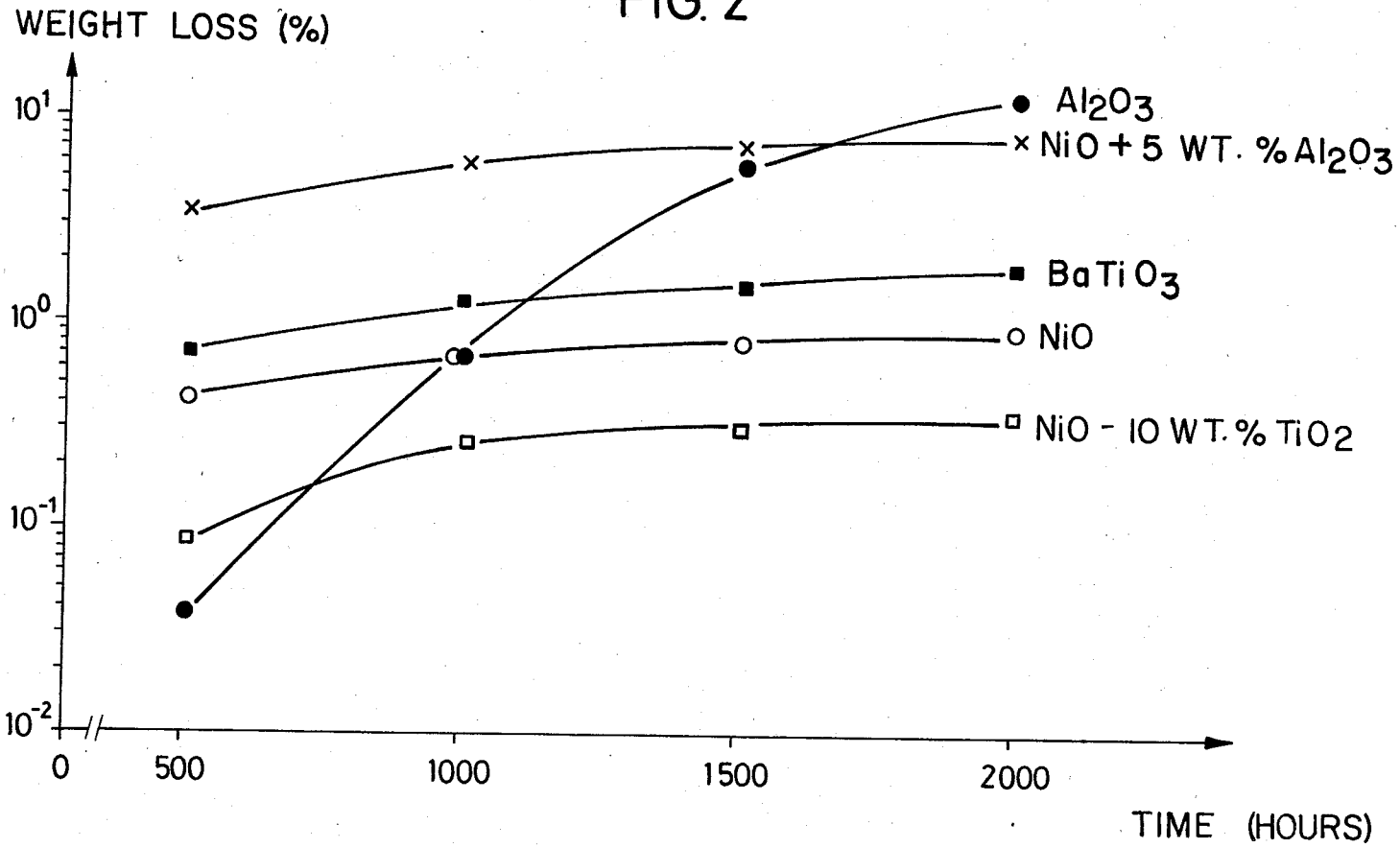
FIG. 2 presents curves showing the long-term loss in weight of ceramic diaphragms in 10 N KOH at 120° C.

However, the chemical stability was markedly improved, as may be seen from FIGS. 1 and 2. The decrease in oxygen in a pure hydrogen atmosphere at 140° to 170° C. is now no longer measurable during the first 2000 hours, which indicates an enormously increased reduction stability. By comparison, a pure NiO diaphragm, for example, loses 7% of the oxygen in 2000 hours, and even a diaphragm stabilized with an addition of $Al_2O_3$ still loses about 1.5% of the oxygen content in the same period of time. In an analogous manner, the already excellent chemical stability in hot KOH is further increased. As FIG. 2 shows, the total weight loss after 2000 hours in 10 N KOH at 120° C. is only 0.3%. By comparison, a pure NiO diaphragm loses 0.8%, a $BaTiO_3$ diaphragm 2% and a diaphragm mixed with 5% $Al_2O_3$ loses 8% of the total weight which is attributable to the $Al_2O_3$.

This positive action of the titanium oxide addition already makes itself noticeable with $TiO_2$ additions of as little as 1 to 2% by weight.

Example 2

By way of comparison, diaphragms were made according to a modified process. Prior to the suspension stage, there is added to the Ni powder, metallic Ti comprising 8% by weight of the mixture, Ti based on the powder mixture and having approximately the same particle sizes as the Ni.

The subsequent steps in the preparation were the same as in Example 1. After the oxidation sintering operation, both the nickel and the titanium were in oxidized form. This diaphragm had the same properties as the diaphragm of Example 1 with regard to its reducibility in an $H_2$ atmosphere.

Comparison Example

Fifty percent of $TiO_2$ was added to the nickel powder prior to the suspension operation. For the rest, the preparation corresponded to that in Example 1. The diaphragm thus produced experienced a total loss in weight of 10% already after 500 hours in 10 N KOH at 120° C.

At this stage the test was discontinued and it was established that diaphragms produced with such a large admixture of $TiO_2$ are unsuitable for alkaline water electrolysis even though the reduction properties (measured as a reduction in weight in a hydrogen atmosphere at 140° to 170° C.) are very good and are not inferior to those of a diaphragm prepared in accordance with Example 1.

The negative action of too high a $TiO_2$ addition first makes itself evident at 20% by weight of $TiO_2$ (corresponding to 10% by weight of Ti, based on the oxidized mass).

What has been described is a process for the manufacture of an improved nickel oxide based diaphragm.

The invention, as described hereinabove in the context of a preferred embodiment, is not to be taken as limited to all of the provided details thereof, since modifications and variations thereof may be made without departing from the spirit and scope of the invention.

What is claimed is:

1. A nickel oxide-based diaphragm for use in alkaline water electrolysis, said diaphragm having a structural metallic frame with a porous nickel oxide layer having a titanium oxide content of between about 1 to 20% by weight of the oxide mass.

2. A nickel oxide-based diaphragm according to claim 1 wherein said titanium oxide content is between about 2 to 10% by weight of the oxide mass.

3. A nickel oxide-based diaphragm according to claim 2 wherein the titanium oxide content is about 5.0% by weight of the oxide mass.

4. A nickel oxide-based diaphragm according to claim 1 wherein the titanium oxide is disposed in a compacted oxidized nickel powder layer on a frame-forming grid of oxidized nickel.

* * * * *